United States Patent [19]

Shields

[11] 4,086,834

[45] May 2, 1978

[54] APPARATUS FOR DIE CUTTING SHEETS OF DIE CUTTABLE MATERIAL

[76] Inventor: Walter A. Shields, 181-41 Henley Rd., Jamaica, N.Y. 11432

[21] Appl. No.: 794,897

[22] Filed: May 9, 1977

[51] Int. Cl.[2] ..... B26F 1/00

[52] U.S. Cl. ..... 83/326; 83/284; 83/328; 83/417

[58] Field of Search ..... 83/284, 326, 327, 417, 83/509, 328

[56] References Cited

U.S. PATENT DOCUMENTS

| | | | |
|---|---|---|---|
| 1,584,095 | 5/1926 | Harshberger | 83/326 X |
| 3,192,856 | 7/1965 | Gavin | 83/326 X |
| 3,301,110 | 1/1967 | Stegner | 83/284 X |
| 3,340,778 | 9/1967 | Boone et al. | 83/326 X |
| 3,443,488 | 5/1969 | Deslauriers | 83/284 X |
| 3,504,584 | 4/1970 | Deslauriers | 83/284 X |
| 3,699,831 | 10/1972 | Mowry | 83/284 X |

*Primary Examiner*—J. M. Meister
*Attorney, Agent, or Firm*—C. Bruce Hamburg

[57] ABSTRACT

Apparatus for die cutting sheets of die cuttable material comprises endless conveyor means, a plurality of platens sequentially mounted on the conveyor means, a respective cutting die mounted on each of the platens, storage means for retaining a plurality of sheets of die cuttable material in a stack, means for removing a respective one of the sheets from the bottom of the stack and positioning the sheet on the cutting die of a respective one of the platens as the platens are continuously, non-reversingly conveyed by the conveyor means and means for pressing the sheet onto the cutting die sufficiently to cause the die to cut through the sheet as the platens are continuously, non-reversingly conveyed by the conveyor means.

5 Claims, 6 Drawing Figures

APPARATUS FOR DIE CUTTING SHEETS OF DIE CUTTABLE MATERIAL

BACKGROUND OF THE INVENTION

This invention relates to apparatus for die cutting sheets of die cuttable material, particularly cardboard.

Sheets of die cuttable material, such as cardborad, paper, plastic and the like are frequently die cut by being pressed against a cutting die. The cutting die is frequently mounted on a platen and is frequently in the form of blades supported by a wooden board. The means for pressing a sheet against the die generally is in the form of a reciprocating press or a roller which rolls back and forth over the sheet on the die. In each case, the pressing operation involves a motion reversal, which is inefficient.

It is, therefore, a principal object of the present invention to provide apparatus for die cutting sheets of die cuttable material the operation of which is not characterized by motion reversals of the pressing means and which, therefore, is more efficient.

Other objects and advantages of the invention will be apparent from the following description thereof.

SUMMARY OF THE INVENTION

According to the invention, there is provided apparatus for die cutting sheets of die cuttable material in which a sheet is pressed onto the cutting die while a platen on which the cutting die is mounted is continuously, non-reversingly conveyed. More particularly, the apparatus comprises endless conveyor means, a plurality of platens sequentially mounted on the conveyor means, a respective cutting die mounted on each of the platens, storage means for retaining a plurality of sheets of die cuttable material in a stack, means for removing a respective one of the sheets from the bottom of the stack and positioning the sheet on the cutting die of a respective one of the platens as the platens are continuously, non-reversingly conveyed by the conveyor means and means for pressing the sheet onto the cutting die sufficiently to cause the die to cut through the sheet as the platens are continuously, non-reversingly conveyed by the conveyor means.

The pressing means preferably comprise a pair of rollers defining a nip therebetween and means for driving the rollers at the same rotational speed and in opposite rotational senses. The nip is so positioned relative to the conveyor means that the conveyor means consecutively convey the respective platens through the nip. The nip is so dimensioned that the sheet is pressed onto the cutting die sufficiently to cause the die to cut through the sheet as the platen carrying the sheet passes through the nip.

The storage means is preferably so oriented as to retain a vertical stack of the sheets with each of the sheets oriented horizontally.

The apparatus preferably includes means for guiding the conveyor in a path having upper and lower horizontal portions and means for continuously supporting the platens in a horizontal orientation. The conveyor means preferably comprise chains and means pivotally connecting the trailing edge of each of the platens to the chains, and the means for supporting the platens in a horizontal orientation as they are conveyed along the upper and lower horizontal portions of the conveyor path preferably comprise respective upper and lower horizontal ride rails. When the conveyor means comprise chains, the means for guiding the conveyor preferably comprise sprockets engaging the chains. The apparatus preferably also includes means for supporting the platens in a horizontal orientation as they travel from the lower to the upper and from the upper to the lower, respectively, horizontal portions of the conveyor path. Each of such supporting means may comprise a respective support arranged for supporting the portion of the platen not connected to the chains at the same level as the trailing edge of the platen and means for vertically displacing the platen in coordination with the vertical movement imparted to the platen in its travel between the upper and lower portions of the conveyor path.

DETAILED DESCRIPTION OF A PREFERRED EMBODIMENT

Figure 1:
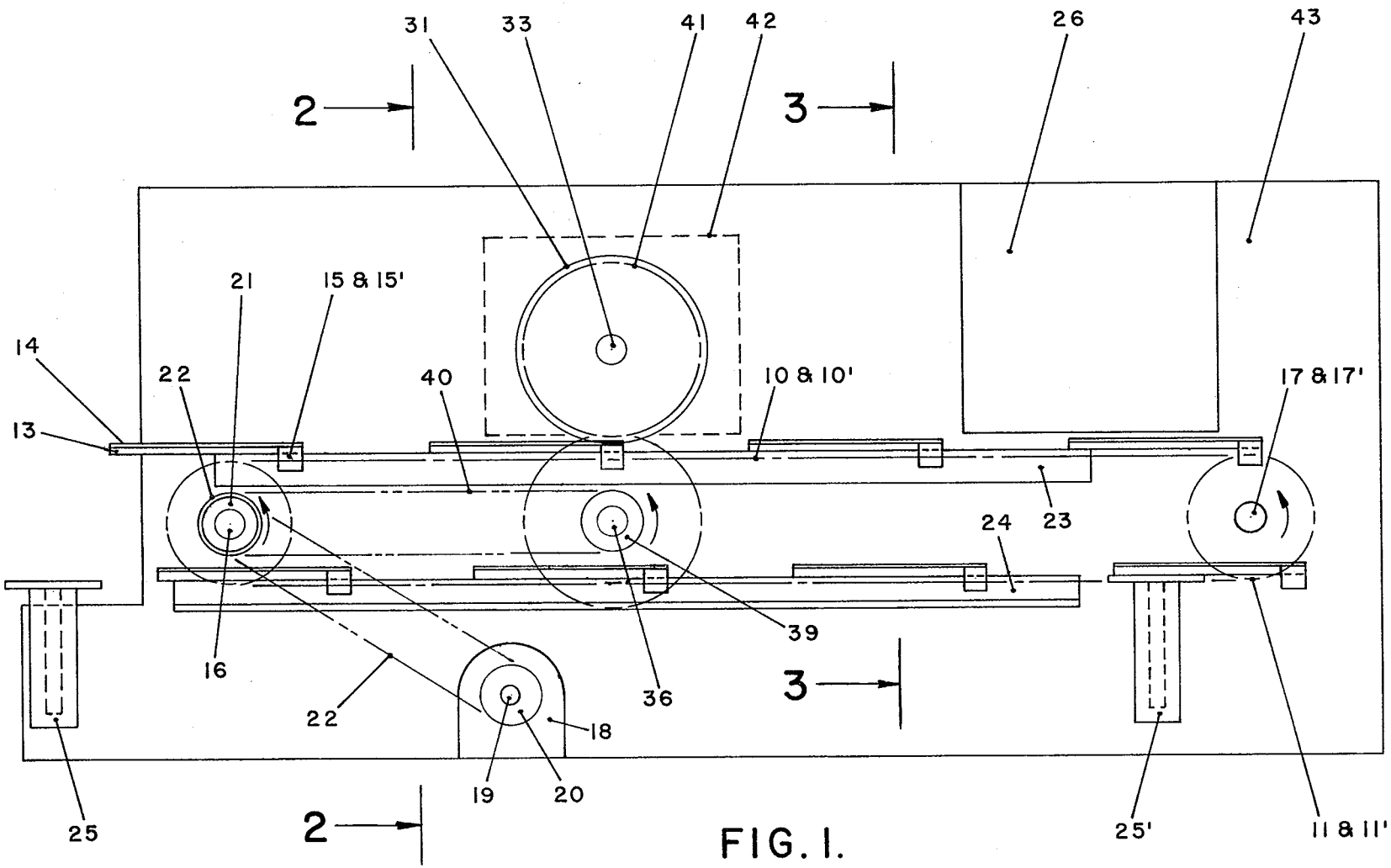
FIG. 1 is a side elevation of an apparatus according to the invention.
Figure 3:
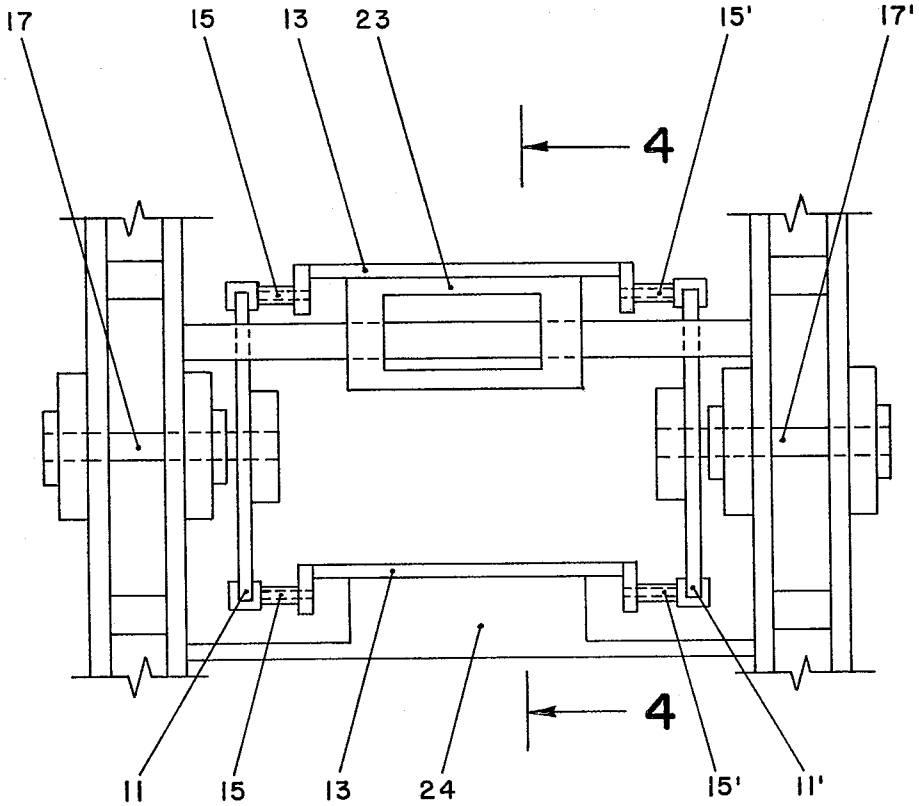
FIG. 3 is a section taken on section line 3—3 of FIG. 1.

An endless chain 10 is trained over sprockets 11 and 12 (FIG. 1). On the opposite side of the machine, not visible in FIG. 1, is provided an identical arrangement of an endless chain 10' and two sprockets 11' and 12'. A plurality of identical platens 13 on each of which is mounted an identical die 14 are each connected to each of the chains 10, 10' by means of respective blocks 15, 15' which are rigidly connected to the platen 13 and pivotally connected to the respective chains 10, 10'. The die 14, which is of conventional construction, will usually be in the form of a wooden board in which are set steel blades extending thereabove to the same height in the configuration of the cuts to be made through the cardboard. The sprocket 12 is connected to the like sprocket 12' at the opposite side of the machine (not illustrated) by means of an ordinary axle 16, and the sprocket 11 is connected to a like sprocket 11' on the opposite side of the machine by means of a split axle 17, 17' (FIG. 3). The chains are driven by a motor 18, the drive shaft 19 of which is operatively connected to the axle 16 by means of a pulley 20 mounted on the drive shaft 19, a pulley 21 mounted on the axle 16 and a drive belt 22 trained over the pulleys 16 and 20.

Each platen 13 is always maintained in a horizontal orientation with the die 14 mounted thereon facing upwardly. This is made possible by the pivotal connection of the blocks 15, 15' to the chains 10, 10', the provision of an upper horizontal ride rail 23 for supporting the platens 13 horizontally as they are pulled by the chains 10, 10' between the pulleys 11, 11' and 12, 12' along the upper portion of the path of travel of the chains, a lower horizontal ride rail for supporting platens 13 horizontally as they are pulled by the chains between the pulleys 11, 11' and 12, 12' along the lower portion of the path of travel of the chains, a vertical displacement mechanism 25' for supporting each platen 13 horizontally as the blocks 15, 15' are carried 180° from the lowest point to the highest point on the pulleys 11, 11' and a vertical displacement mechanism 25' for supporting each platen 13 horizontally as the blocks 15, 15' are carried 180° from the highest point on the pulleys 12, 12' to the lowest point on the pulleys 12, 12'. As illustrated herein, the vertical displacement mechanisms 25', 25 are pneumatic cylinder and piston assemblies. Obviously, however, other lifting and lowering mechanisms such as cam actuated mechanisms may be utilized.

Figure 4:
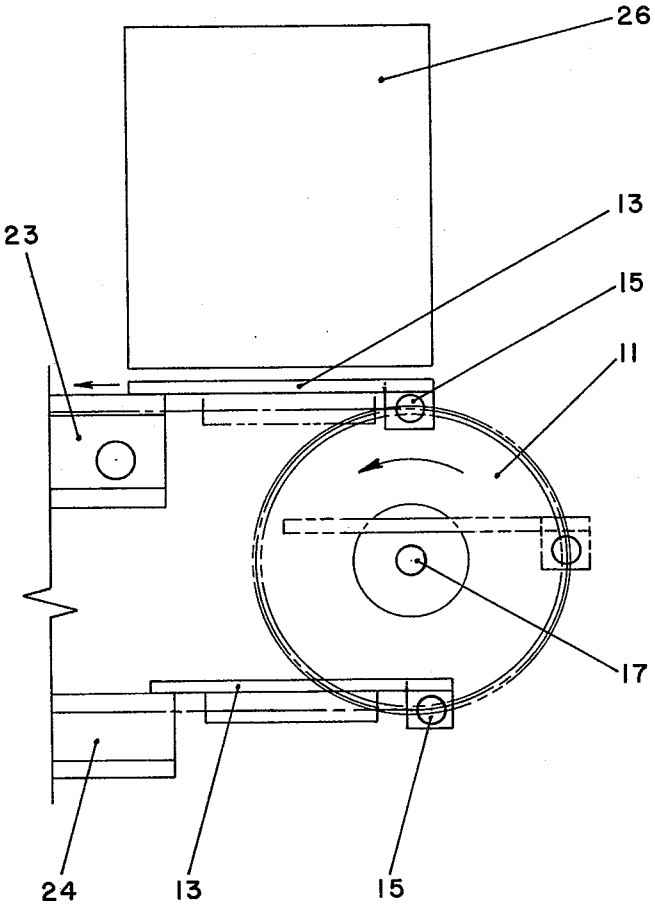
FIG. 4 is a section taken on section line 4—4 of FIG. 3.
Figure 6:
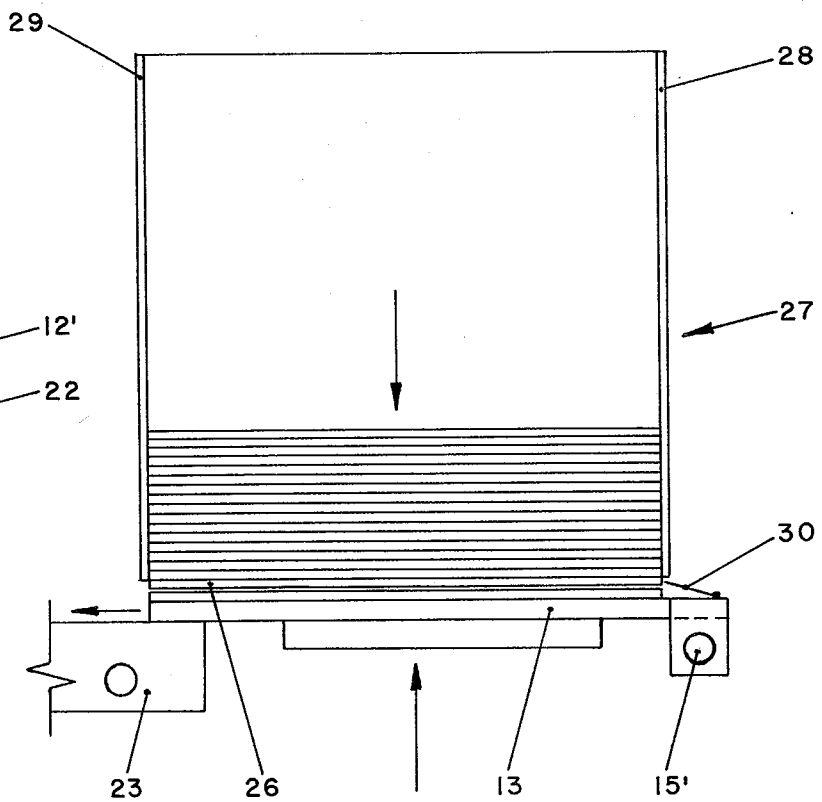
FIG. 6 is a side elevation of a portion of the apparatus of FIG. 1 near the right hand end thereof.

The cardboard sheets 26 to be cut are stacked vertically each in a horizontal orientation in a hopper 27 located directly over the upper portion of the path of movement of the platens 13 and at or near the upstream end of said upper portion (FIGS. 1, 4, 6). The lateral edges of the bottom of the stack rest on respective inwardly directed lips (not illustrated) formed at the bottom lateral edges (not illustrated) of the hopper 27. If the cross-machine width of the sheets is relatively great and/or the sheets 26 are relatively pliable whereby the sheets would tend to sag at an unsupported middle portion of the width thereof, one or more support rails may be provided spanning in the machine direction between the end members 28 and 29 of the hopper 27 at the lower edges thereof in between the lateral walls of the hopper 27.

Near the edge of each platen 13 which edge is the trailing edge of the platen when the platen is traversing the upper portion of its path of travel is provided one or more fingers 30. For the sake of simplicity, the finger 30 will hereinafter be referred to in the singular. It will be understood, however, that a plurality thereof could also be used. The end structures 28 and 29 of the hopper 27 are open at the intersection thereof with the path of travel of that portion of the platen 13 on which the finger 30 is mounted thereby to permit the finger 30 to discharge the bottom of one of the sheets 26 from the hopper 27 onto the platen 13.

Downstream from the hopper 26 are provided nip rollers 31 and 32. The roller 31 is mounted on a shaft 33 supported by flange ball bearings 34 and 35. Similarly, the roller 32 is mounted on a shaft 36 supported by flange ball bearings 37 and 38. A second pulley 22 is mounted on the shaft 16, and a pulley 39 is mounted on the shaft 36. The shaft 36 is operatively connected to the shaft 16 by means of a drive belt 40 trained over the pulleys 22 and 39. The shafts 33 and 36 are operatively connected by a gear train 41 which causes the shafts 33 and 36 and, consequently, the rollers 31 and 32 to rotate at the same r.p.m. in opposite senses. Conventional means, such as an adjustment plate 42, may be provided for adjustment of the height, i.e., the vertical dimension of the nip. Finally, the entire apparatus of the invention is, of course, mounted on a suitable frame 43.

The hereinabove described apparatus operates to die cut the cardboard sheets 26 in the following manner:

First, it is to be understood that each platen 13 is like the others, being provided with a finger 30. A cycle of operation of one platen 13 will be described, it being understood that each platen 13 operates in the same manner. As an arbitrary "starting point" of the cycle, for the purpose of describing a cycle, the oposition of a platen 13 as it is about to be transferred from the lower portion to the upper portion of the chains 10, 10' is herein selected.

As the portion of the chains 10, 10' to which the blocks 15, 15' are connected is engaged by the sprockets 11, 11', the piston of the assembly 25' is acutated vertically upwardly in coordination with the vertically upward component of the motion imparted to the blocks 15, 15' by the engagement of the chains 10, 10' by the sprockets 11, 11' so that the platen 13 remains horizontal (FIGS. 1, 4 and 6). It can readily be appreciated that to prevent interference with the platen 13 as it is thus conveyed in a horizontal orientation by the sprockets 11, 11', the split axle 17, 17' arrangement illustrated in FIG. 3 is necessary.

Before the piston of the assembly 25' is lowered to a ready position to lift the next platen 13 in the same manner, the leading edge of the platen 13 which has just been lifted is permitted to ride onto the upper horizontal ride rail 23 whereby the platen 13 continues to be supported in a horizontal orientation when it no longer is supported by the piston of the assembly 24. As the leading edge of the platen 13 rides onto the ride rail 23 (FIG. 6), the finger 30 comes into engagement with the right edge (FIG. 6) of the bottom cardboard sheet 26 of the stack in the hopper 27. Consequently, as the leftward travel of the platen 13 continues, the bottom cardboard sheet is carried on the platen 13 and is pushed out of the hopper 27 by the finger 30. Gravity causes the stack to drop by a distance equal to the thickness of the cardboard sheet 26 which has just been removed so that the next cardboard sheet 26 assumes the same bottom location of the stack to be deposited onto the next platen 13.

Figure 2:
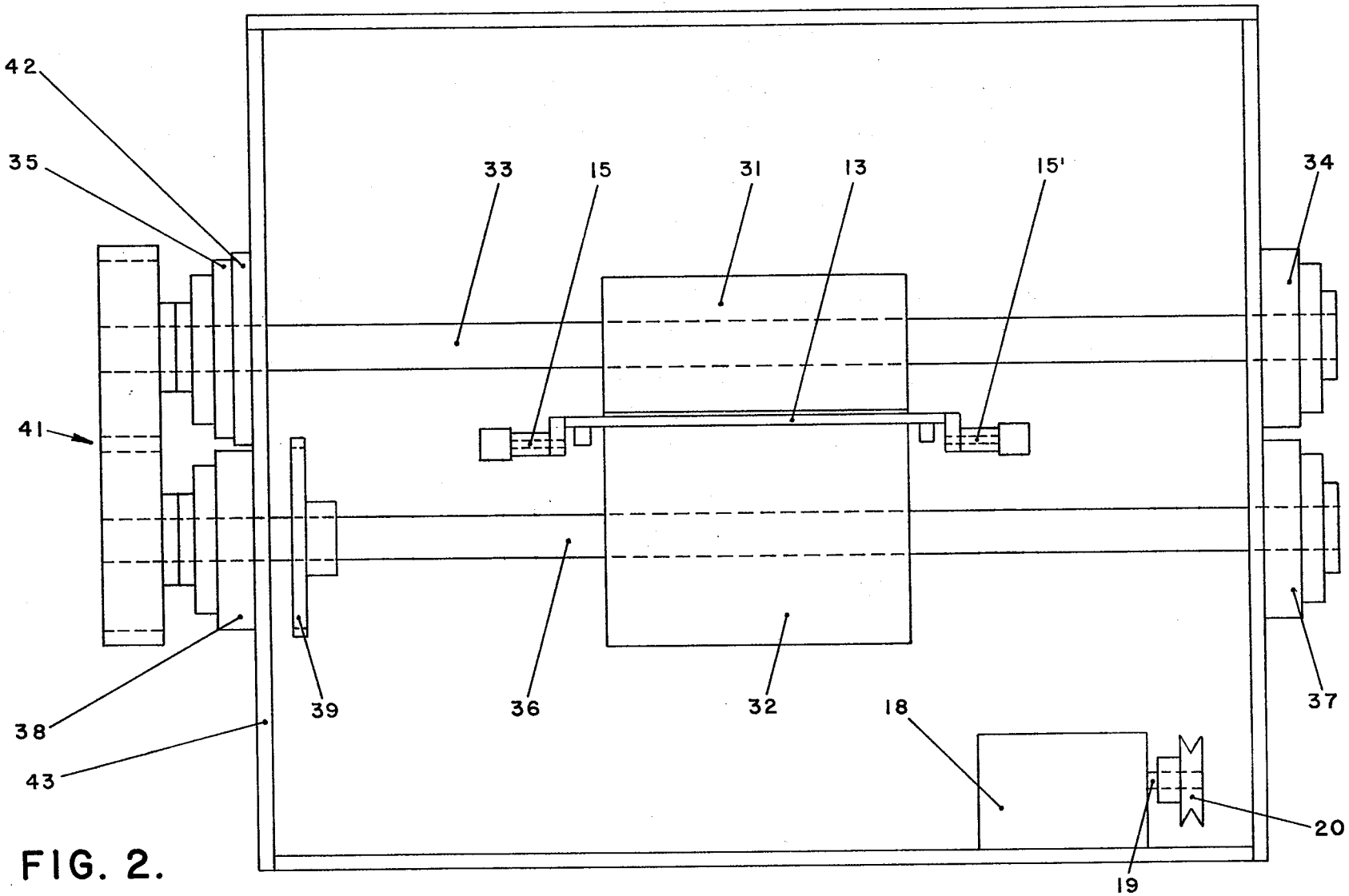
FIG. 2 is a section taken on section line 2—2 of FIG. 1.

As the leftward travel of the platen 13 is continued, the platen enters the nip between the rollers 31 and 32 (FIGS. 1, 2). The height of the nip is equal to the maximum thickness of the platen 13 including the die 14. In other words, the edtes of the blades of the die 14 will just touch the upper roller 31 as the platen 13 passes through the nip. Of course, the precision of machinery cannot be absolute. However, the natural compressibility and resiliency of the wooden board in which the blades are mounted will permit the platen 13 to pass through the nip if the maximum thickness of the platen including the die blades, with the wooden board uncompressed, is slightly greater than the height of the nip. The height of the edges of the blades above the wooden board is greater than, or at least equal to, the thickness of the cardboard sheet 26. Consequently, the passing through the nip of the platen 13 carrying the cardboard sheet 26 causes the blades of the die 14 to cut through the cardboard sheet 26. The finger 30 is spring biased or itself fabricated of spring steel in the configuration of a leaf spring so that it is pushed down out of the way as it passes through the nip and returns to its operative orientation as it leaves the nip. As the platen 13 carrying the cut cardboard sheet 26 approaches or reaches the leftward extremity of its travel, the cut sheet may be removed from the platen 13 manually or by conventional automatic handling apparatus not constituting part of the present invention.

Figure 5:
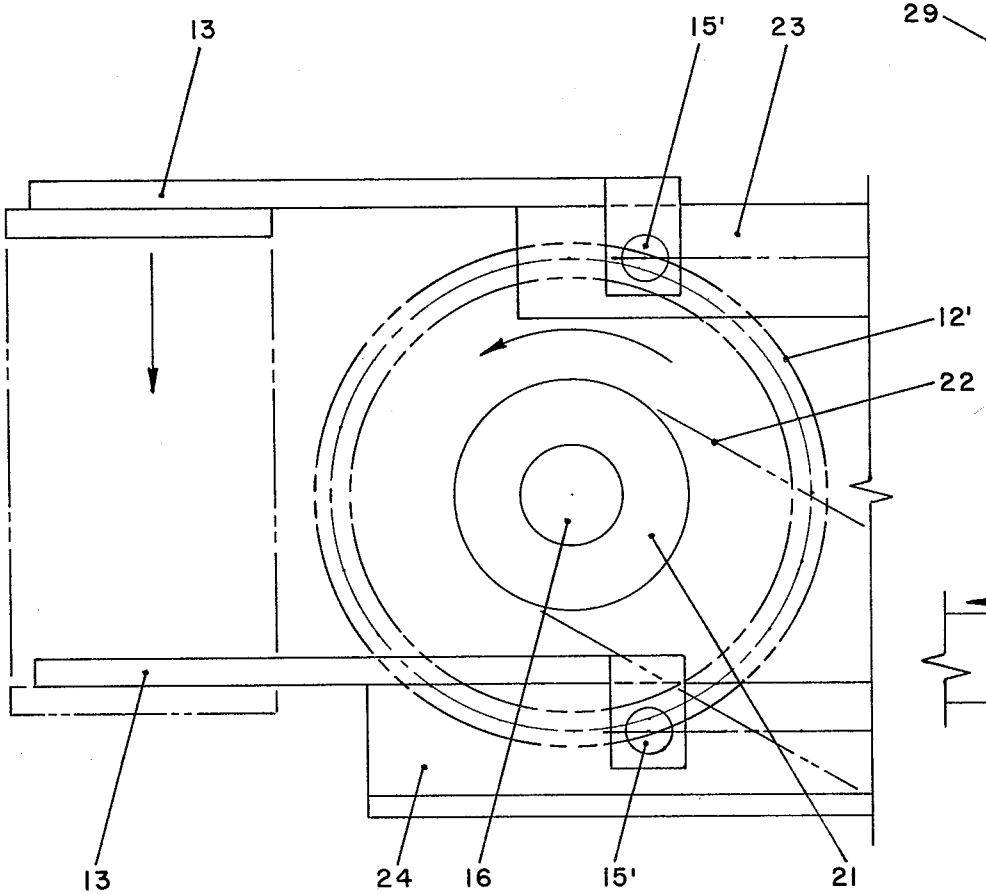
FIG. 5 is a side elevation of a portion of the left hand end of the apparatus of FIG. 1.

As the portion of the chains 10, 10' to which the blocks 15, 15' are connected is engaged by the sprockets 12, 12', the piston of the assembly 25 is actuated downwardly from the solid line position illustrated in FIG. 5 to the broken line position illustrated in FIG. 5 is coordination with the vertically downward component of the motion imparted to the blocks 15, 15' by the engagement of the chains 10, 10' by the sprockets 12, 12' so that the platen 13 remains horizontal. Before the piston of the assembly 25 is raised to a ready position to lower the next platen 13 in the same manner, the leading edge of the platen 13 which has just been lowered is permitted to ride onto the lower horizontal ride rail 24 whereby the platen 13 continues to be supported in horizontal orientation when it no longer is supported by the piston of the assembly 25. The platen 13, supported horizintally by the lower ride rail 24, is then pulled rightward by the chains 10, 10' to the position arbitrarily selected in the above description as the "starting position."

The present invention includes all variations and modifications of the above described apparatus which would be obvious to one skilled in the art. For example, the finger 30 may be of a construction not incorporating a spring and the finger 30 may be moved into and held in its operative position by cam means prior to reaching the hopper 27 and thereafter may be lowered by the cam means prior to entering the nip of the rollers 31 and 32. Another example of a variation or modification of the above described apparatus is that the air cylinder and piston assemblies 25' and 25 may be replaced by cam actuated swinging arms for raising and lowering the platens 13. These and all other variations and modifications are intended to be encompassed by the scope of the present invention as defined by the hereto appended claims.

What I claim is:

1. Apparatus for die cutting sheets of die cuttable material, comprising endless conveyor means, means for guiding the conveyor means in a path having upper and lower horizontal portions, a plurality of platens sequentially mounted on said converyor means, means for continuously supporting the platens in a horizontal orientation, a respective cutting die mounted on each of said platens, a storage means oriented for retaining a plurality of sheets of die cuttable material in a vertical stack with each of the sheets oriented horizontally, means for removing a respective one of said sheets from the bottom of said stack and positioning said sheet on the cutting die of a respective one of said platens as the platens are continuously non-reversingly conveyed by said conveyor means, a pair of rollers defining a nip therebetween and means for driving the rollers at the same rotational speed and in opposite rotational senses, the nip being so positioned relative to the conveyor means that the conveyor means consecutively convey the respective platens through the nip and the nip being so dimensioned that the sheet is pressed onto the cutting die sufficiently to cause the die to cut through the sheet as the platen carrying the sheet passes through the nip.

2. Apparatus according to claim 1, in which said conveyor means comprise chains and means pivotally connecting the trailing edge of each of the platens to the chains and the means for guiding the conveyor comprise sprockets engaging the chains.

3. Apparatus according to claim 2, in which the means for supporting the platens in a horizontal orientation as they are conveyed along said upper and lower horizontal portions of said conveyor path comprise respective upper and lower horizontal ride rails.

4. Apparatus according to claim 3, including means for supporting the platens in a horizontal orientation as they travel from the lower to the upper and from the upper to the lower, respectively, horizontal portions of said conveyor path.

5. Apparatus according to claim 4, in which each of said supporting means comprises a respective support arranged for supporting the portion of the platen not connected to the chains at the same level as the trailing edge of the platen and means for vertically displacing the platen in coordination with the vertical component of the movement imparted to the platen in its travel between said upper and lower portions of said conveyor path.

* * * * *

UNITED STATES PATENT AND TRADEMARK OFFICE

CERTIFICATE OF CORRECTION

PATENT NO. : 4,086,834

DATED : May 2, 1978

INVENTOR(S) : Walter A. Shields

It is certified that error appears in the above-identified patent and that said Letters Patent are hereby corrected as shown below:

Column 3, line 60, change "oposition" to --position--;
line 66, change "acutated" to --actuated--.
Column 4, line 31, change "edtes" to --edges--;
line 59, change "is" to --in--;
line 68, change "in horizontal" to --in a horizontal--.
Column 5, line 2, change "horizin" to --horizon--;
line 27, change "converyor" to --conveyor--.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*